United States Patent [19]

Dulog et al.

[11] 4,147,673

[45] Apr. 3, 1979

[54] DETERGENT COMPOSITION CONTAINING SULFINYL DIPROPIONIC ACIDS

[75] Inventors: Lothar G. Dulog, St. Martens-Latem, Belgium; Alfred G. Maasböl, Hamburg, Fed. Rep. of Germany

[73] Assignee: s.a. Texaco Belgium n.v., Brussels, Belgium

[21] Appl. No.: 567,331

[22] Filed: Apr. 11, 1975

[51] Int. Cl.[2] ..... C11D 1/14; C11D 3/34

[52] U.S. Cl. ..... 252/548; 252/549; 252/554; 252/558; 252/DIG. 11; 252/DIG. 14

[58] Field of Search ..... 252/89, 530, 549, 554, 252/558, DIG. 14, DIG. 11, 548; 260/535 P, 537 S

[56] References Cited

U.S. PATENT DOCUMENTS

| | | | |
|---|---|---|---|
| 3,527,707 | 9/1970 | McAteer et al. | 252/535 |
| 3,635,829 | 1/1972 | Yang | 252/526 |
| 3,635,830 | 1/1972 | Lamberti et al. | 252/89 X |
| 3,692,685 | 9/1972 | Lamberti et al. | 252/89 |
| 3,707,503 | 12/1972 | Kenney | 252/177 |
| 3,753,913 | 8/1973 | Jarowenko | 252/89 |
| 3,764,569 | 10/1973 | Ali et al. | 252/554 |

OTHER PUBLICATIONS

Beilstein, E1113, 4th Edition, pp. 425 and 553.

*Primary Examiner*—P. E. Willis, Jr.
*Attorney, Agent, or Firm*—Thomas H. Whaley; Carl G. Ries; Henry W. Archer

[57] ABSTRACT

Disclosed is a detergent composition containing from 0.1 to 1.0 percent by weight of a sulfinyl dipropionic acid of the formula:

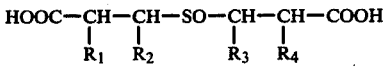

wherein $R_1$, $R_2$, $R_3$ and $R_4$ can be the same or different and are hydrogen or lower alkyl. The preferred compound is sulfinyl dipropionic acid.

4 Claims, No Drawings

DETERGENT COMPOSITION CONTAINING SULFINYL DIPROPIONIC ACIDS

BACKGROUND OF THE INVENTION

Field of the Invention

This invention relates to the novel use of sulfinyl-carboxylic acids as sequestrants and detergent builders in the place of polyphosphates.

Since polyphosphates are known to cause eutrophication of bodies of water in which they are found, various candidates have been proposed in their stead in detergent formulations. One suggested replacement, nitriloacetic acid, performs satisfactorily but the suspected formation of carcinogenic intermediates during its biological degradation limits its acceptance.

To replace polyphosphates in a detergent formulation a compound must possess several characteristics. It must be biodegradable but must remain stable in hard water. It must inhibit lime-soap precipitation when used in excess over calcium ions. It must be odor-compatible with other detergent compositions components while remaining stable at ambient temperature.

SUMMARY OF THE INVENTION

It has been found that water soluble salts of sulfinyl dipropionic acids are excellent replacements for polyphosphates in detergent compositions as sequestering agents and builders. The invention thus considers in the incorporation in a detergent composition of from 0.1 to 1.0 of a water soluble salt of a sulfinyl dipropionic acid. The acids are those encompassed by the formula:

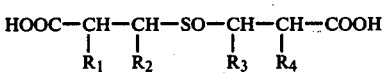

wherein $R_1$, $R_2$, $R_3$, and $R_4$ are the same or different and can be hydrogen or lower alkyl having up to 5 carbon atoms. However, biodegradability and water solubility decreases and biological oxygen demand increases as the number of carbon atoms per molecule increases so that the preferred compounds are those where $R_1$ and $R_4$ are methyl and $R_2$ and $R_3$ are hydrogen and where $R_2$ and $R_4$ are methyl. The more preferred compound is sulfinyl dipropionic acid. Because of the shortness of its molecular chain, this acid has a low biological and chemical oxygen demand.

DISCLOSURE

Sulfinyl dipropionic acid can be prepared as described in Beilstein E 1113, page 425 and 553, 4th Edition by oxidizing thiodipropionic acid in acetone with 30 percent hydrogen peroxide while cooling with ice. The progress of the reaction is followed by titration and, at its termination, the solution is evaporated to give white crystals of sulfinyldipropionic acid melting at 114° C. The free acid is converted to its water soluble salt by reaction with an aqueous base such as NaOH, or KOH.

The compound where $R_1$ and $R_4$ are methyl and $R_2$ and and R are hydrogen is prepared from methacrylic acid. The compound where $R_1$ and $R_4$ are hydrogen and $R_2$ and $R_4$ are methyl is prepared from crotonic and isocrotonic acids.

A typical detergent formulation in which the present compounds can be used consists of the following components:

3 to 9 weight percent of a hydrotrope such as xylene sulfonate or a $C_{7-8}$ linear alkylsulfonate;

15 to 30 percent of linear alkyl sulfonate; up to 5 weight percent of a stabilizer such as a fatty acid alkylamide foam; 0.1 to 1.0 weight percent sodium sulfinyl dipropionate; the balance water.

Screening tests were carried out with the sodium salt of sulfinyldipropionic acid and were compared with those of other known sequestering agents. These materials were sodium hexametaphosphate
oxydiacetic acid (as sodium salt)
nitrilotriacetic acids (as sodium salt).

All products showed excellent stability against hard water, even when the concentration of calcium in water was in excess of the added sequestering compounds; all solutions remained clear.

These experiments clearly show that sulfinyldipropionic acid (as its sodium salt) does not form a calcium salt which is less soluble as known from higher carboxylic acids.

The tests were done according to hard water stability tests according to the German procedure DIN 53905. The results appear in Table I.

Also investigated were the effect of sulfinyldipropionic acid (as sodium salt) and of known sequestering compounds on the hard water behavior of a soap. As soap sodium oleate was used. The hard water stability of sodium oleate is shown in Table II.

It is known that the stability of sodium oleate is moderate to poor and that it decreases with increased water hardness.

The effect of sodium sulfinyldipropionate and of the other compounds mentioned above was checked in a modification of the DIN 53905 procedure for hard water stability of soaps, consisting in adding known amount to the hard water of the compounds to be tested, (see Table III) in addition to the soap solution. Three water hardness degrees were used 6, 9 and 12 in equivalents per liter resp. Two series of runs were made, one at constant ratio of soap and sequestering agent but at decreasing concentrations, and another at constant sequestering agent concentration and decreasing soap concentration.

A comparison of the hard water stability of sodium-sulfinyldipropionate (Tables II and III) reveals an improvement in hard water characteristics.

The sodium salt of sulfinyldipropionic acid is equivalent to the sodium salt of oxydiacetic acid and approaches the characteristics of sodium hexametaphosphate. The sodium salt of nitrilotriacetic acid is better than the above mentioned compounds.

Launder-O-Meter tests were made to evaluate the behavior sulfinyldipropionic acid (as its sodium salt) in detergency tests. The effectiveness of the test solution was checked in a standardized washing procedure under the following conditions:

temperature 60° C.
washing time 10 minutes
standard detergent Korenyl neu from DTA in 0.1 and 0.2% w/v
compound/detergent ratio: 70/30
water of Ca hardness of 6 m equivalent/1 (300 ppm)

As reference washing solution was used: 0.1 w/v Texapone N25 without added compound at 6 m equivalent Ca hardness (300 ppm).

The effectiveness of the test solution is reported in percent detergency. This value is calculated from reflectance measurements of cloths as follows:

$$\% \text{ detergency} = \frac{R_{sw} - R_{su}}{R_{uu} - R_{su}} \cdot 100$$

$R_{sw}$ = reflectance of cloth soiled washed
$R_{su}$ = reflectance of cloth soiled unwashed
$R_{uu}$ = reflectance of cloth unsoiled unwashed
$R_{su}$ = reflectance of cloth soiled unwashed Test results are presented in Table IV and V.

At 0.1% (w/v) detergency concentration the sodium salt of sulfinyldipropionic acid shows an increase in the detergency which is not as marked as with sodium hexamethaphosphate, sodium oxydiacetate of sodium nitrilotriacetic acid. The advantage over the sodium salts of oxydiacetic acid and nitrilotriacetic acid is the lower pH of the washing solution containing sulfinyldipropionate.

At detergency concentrations of 0.2% (w/v) the sodium salt of sulfinyldipropionic acid shows a detergency increase as high as the other compounds tested.

The above tests clearly demonstrate sodium sulfinyldipropionate to be a compound exhibiting characteristics which make it valuable as a sequestering agent in detergent formulations.

The analogous thiocompounds:

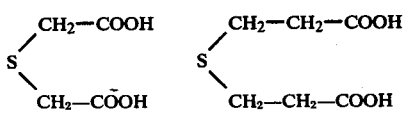

do not exhibit promising hard water characteristics for soaps. The homolog sulfinyl diacetic acid is unstable and not odor-compatible with detergent formulations.

TABLE I

RATING FOR HARD WATER STABILITY OF SEVERAL COMPOUNDS

| Compound | Ca hardness m equ./1 | Ratings at various concentration of compounds concentration in mmole/1 20 | 10 | 4.8 | 2.4 | 1.2 |
|---|---|---|---|---|---|---|
| Sodium Sulfinyl dipropionate | 6 | 5 | 5 | 5 | 5 | 5 |
| | 9 | 5 | 5 | 5 | 5 | 5 |
| | 12 | 5 | 5 | 5 | 5 | 5 |
| Sodium hexa- | 6 | 5 | 5 | 5 | 5 | 5 |

TABLE I-continued

RATING FOR HARD WATER STABILITY OF SEVERAL COMPOUNDS

| Compound | Ca hardness m equ./1 | Ratings at various concentration of compounds concentration in mmole/1 20 | 10 | 4.8 | 2.4 | 1.2 |
|---|---|---|---|---|---|---|
| metaphosphate | 9 | 4 | 5 | 5 | 5 | 5 |
| | 12 | 4 | 5 | 5 | 5 | 5 |
| Sodium oxy- | 6 | 5 | 5 | 5 | 5 | 5 |
| diacetate | 9 | 5 | 5 | 5 | 5 | 5 |
| | 12 | 5 | 5 | 5 | 5 | 5 |

Ratings:
1: Heavy precipitate
2: slight precipitate
3: turbid
4: opalescent
5: clear

TABLE II

RATING OF HARD WATER STABILITY OF SODIUM OLEATE (SOAP) ACCORDING TO DIN 53905

| Ca hardness m equ/1 | Ratings for various soap concentrations concentrations in mmole/1 20 | 10 | 4.8 | 2.4 | 1.2 |
|---|---|---|---|---|---|
| 6 | 1 | 2 | 3 | 4 | 4 |
| 9 | 1 | 1 | 1 | 3 | 4 |
| 12 | 1 | 1 | 1 | 2 | 3 |

Ratings:
1: heavy precipitate
2: slight precipitate
3: turbid
4: opalescent
5: clear

TABLE III

HARD WATER STABILITY OF SODIUMOLEATE (SOAP) IN PRESENCE OF VARIOUS COMPOUNDS AT DIFFERENT CONCENTRATIONS

| Compound | Ca Hardness m equ/1 | Soap Compound | Ratings at various concentrations of sodium-oleate and compounds; concentrations in mmole/1 1.0 1.2 | 2.0 2.4 | 4.0 4.8 | 8.3 10.0 | 16.6 20.0 | 8.3 20.0 | 4.0 20.0 | 2.0 20.0 | 1.0 20.0 |
|---|---|---|---|---|---|---|---|---|---|---|---|
| Sodiumsulfinyl- | 6 | | 3 | 3 | 3 | 3–4 | 4 | 3 | 3 | 4 | 4 |
| dipropionate | 9 | | 2 | 2 | 3 | 3 | 4 | 3 | 3 | 4 | 4 |
| | 12 | | 2 | 2 | 2–3 | 3 | 3–4 | 3 | 3 | 4 | 4 |
| Sodiumhexameta | 6 | | 3 | 3 | 4 | 5 | 4 | 3 | 3 | 3–4 | 4 |
| phosphate | 9 | | 3 | 3 | 3 | 5 | 4 | 3 | 3 | 3–4 | 4 |
| | 12 | | 3 | 3 | 3 | 5 | 4 | 3 | 3 | 3–4 | 4 |
| Sodiumoxydiace- | 6 | | 3 | 3 | 3 | 3 | 3–4 | 3 | 3 | 4 | 4 |
| tate | 9 | | 2 | 2 | 3 | 3 | 3 | 3 | 3 | 4 | 4 |
| | 12 | | 2 | 2 | 3 | 3 | 3 | 3 | 3 | 4 | 4 |
| Sodiumnitrilotri- | 6 | | 1 | 3 | 3 | 4 | 5 | 5 | 5 | 5 | 5 |
| acetate | 9 | | 1 | 2 | 2–3 | 3 | 5 | 5 | 5 | 5 | 5 |
| | 12 | | 1 | 1 | 3 | 3 | 4 | 4–5 | 5 | 5 | 5 |

Rating: as in Tables I and II

TABLE IV

LAUNDER-O-METER TESTS, DETERGENT KORENYL NEU 0.1 % W/V
Ca HARDNESS 6 m eq/1 (300 ppm)
ADDED COMPOUND TO DETERGENT RATIO 70/30

| Added compound | detergency | pH of washing solution |
|---|---|---|
| None | 10.8 | 5.8 |
| sodiumsulfinyldipropio- | 20.3 | 6.0 |
| nate | | |
| sodiumhexametaphosphate | 42.9 | 5.8 |
| sodiumoxydiacetate | 36.7 | 11.4 |
| sodiumnitrilotriacetate | 39.5 | 10.6 |
| pentasodiumtripolyphos- | 41.1 | 9.2 |
| phate | | |
| Reference (Texapone) without added compound | 37.3 | — |

TABLE V

LAUNDER-O-METER TESTS,
DETERGENT KORENYL NEU 0.2% W/V
Ca HARDNESS 6 m eq/1 (300 ppm)
ADDED COMPOUND TO DETERGENT RATIO 70/30

| Added Compound | Detergency | pH of washing solution |
|---|---|---|
| None | 30.1 | 6.3 |
| Sodiumsulfinyldipropionate | 40.2 | 6.1 |
| Sodiumhexametaphosphate | 42.4 | 6.1 |
| Sodiumoxydiacetate | 38.3 | 11.7 |
| Sodiumnitrolotriacetate | 41.2 | 10.9 |
| Pentasodiumtripolyphosphate | 41.7 | 9.3 |
| Reference Texapone N25 without added compound | 38.4 | — |

What is claimed is:

1. A detergent composition containing from about 3 to about 9 weight percent of a xylene sulfonate or (lower) alkyl sulfonate hydrotrope, from 15 to 30 weight percent of a linear alkylsulfonate, up to 5 weight percent of a fatty acid amide foam stabilizer and as a sequestrant and detergent builder from 0.1 to 1.0 weight percent of a water soluble alkali metal salt of a sulfinyl dipropionic acid of the formula:

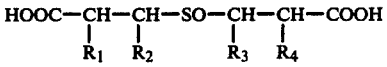

wherein $R_1$, $R_2$, $R_3$ and $R_4$ are the same or different and are hydrogen or lower alkyl, the balance water.

2. The composition of claim 1, wherein said acid is sulfinyl dipropronic acid.

3. The composition of claim 1, wherein $R_1$ and $R_4$ are methyl and $R_2$ and $R_3$ are hydrogen.

4. The composition of claim 1, wherein $R_1$ and $R_4$ are hydrogen and $R_2$ and $R_3$ are methyl.

* * * * *